US006434782B2

(12) United States Patent
Wakat et al.

(10) Patent No.: US 6,434,782 B2
(45) **Date of Patent: *Aug. 20, 2002**

(54) PAINTING APPARATUS

(75) Inventors: George H. Wakat, St. Paul Park; James A. Thole, Maple Grove, both of MN (US)

(73) Assignee: Wagner Spray Tech Corporation, Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/896,862

(22) Filed: Jun. 29, 2001

Related U.S. Application Data

(60) Continuation of application No. 09/551,702, filed on Apr. 18, 2000, now Pat. No. 6,279,194, which is a continuation of application No. 09/317,494, filed on May 24, 1999, now Pat. No. 6,145,158, which is a division of application No. 08/838,860, filed on Apr. 11, 1997, now Pat. No. 5,956,802.

(51) Int. Cl.[7] ..... B05C 21/00; B65D 1/36

(52) U.S. Cl. ..... 15/257.06; 15/257.05; 220/570; 220/736

(58) Field of Search ..... 15/142, 257.01, 15/257.05, 257.06, 264; 220/507, 553, 555, 570, 736

(56) References Cited

U.S. PATENT DOCUMENTS

| | | | |
|---|---|---|---|
| 2,255,091 | A | 9/1941 | Vaughn |
| 2,659,096 | A | 11/1953 | Mencfeldowski, Jr. |
| 2,659,917 | A | 11/1953 | Drum |

(List continued on next page.)

FOREIGN PATENT DOCUMENTS

| | | | |
|---|---|---|---|
| CA | 559080 | 6/1958 | |
| DE | 1 035 022 | 11/1956 | |
| DE | 1035022 | * 7/1958 | ..... 15/257.06 |
| DE | 1039419 | 9/1958 | |
| DE | 2140189 | 2/1973 | |
| DE | 2 306 251 | 8/1973 | |
| DE | 29506740 | 7/1995 | |
| DE | 19852865 | 11/1998 | |
| EP | 0 151 876 | 8/1985 | |
| EP | 0564362 | 10/1993 | |
| FR | 1 118 578 | 6/1956 | |
| FR | 7305088 | 8/1973 | |
| FR | 2 322 754 | 1/1977 | |
| FR | 2686810 | 8/1993 | |
| GB | 805475 | 12/1958 | |

OTHER PUBLICATIONS

Harrington, L., et al., "Color: A Stroke of Brilliance; A Guide to Color & Decorating with Paint". Benjamin Moore & Co., Montvale, J.J., 104–107.

EZ Paintr brochure *The Drawing of a New Age in Paint Applicators*! Cat. 101–90 4 84 (4 pages) Copyright 1984.

*Primary Examiner*—Randall E. Chin
(74) *Attorney, Agent, or Firm*—Faegre & Benson, LLP

(57) ABSTRACT

A paint apparatus is disclosed having a plurality of trays for use with a paint roller. A paint reservoir within each tray retains the paint. A grid portion is integrally formed in a lower surface of the paint apparatus, and has a plurality of channels and/or projections. The channels are curved, thereby providing increased surface area for the paint roller. The paint apparatus is also included in a kit containing paint application devices, practice paper, and instructional materials. The paint apparatus is further provided with a metering system which includes a plurality of grids and a mesh structure. The stackable grids are placed within the paint reservoir and permit the paint to wick up to a top surface of the stackable grids. During use of the apparatus, a user fills the paint reservoir with paint to a point below the top surface of the stackable grids. The user the rolls the rolling device over the grids, thereby loading the nap portion with paint. As a result, a roller is loaded with an appropriate amount of paint for painting on a wall surface. Another metering device provided is a metering mesh which is secured over the paint reservoir.

18 Claims, 5 Drawing Sheets

U.S. PATENT DOCUMENTS

| | | | | |
|---|---|---|---|---|
| 2,778,050 | A | | 1/1957 | Meinhardt |
| 2,838,781 | A | | 6/1958 | Molle |
| 2,909,797 | A | | 10/1959 | White |
| 2,994,901 | A | | 8/1961 | Ely |
| 3,102,327 | A | | 9/1963 | Wiegand |
| 3,157,902 | A | | 11/1964 | Hardwick |
| 3,521,808 | A | | 7/1970 | Weiss |
| D220,850 | S | | 6/1971 | Davis |
| 3,609,049 | A | | 9/1971 | Smyth |
| 3,707,242 | A | | 12/1972 | Golden et al. |
| 3,745,624 | A | | 7/1973 | Newman |
| D230,086 | S | | 1/1974 | Meisner |
| 4,010,866 | A | | 3/1977 | McClane |
| 4,029,011 | A | | 6/1977 | Kurner |
| 4,102,468 | A | | 7/1978 | Goldman |
| 4,191,792 | A | | 3/1980 | Janssen |
| 4,356,588 | A | | 11/1982 | Martucci |
| 4,434,521 | A | | 3/1984 | Martin et al. |
| 4,467,509 | A | | 8/1984 | Dezen |
| D286,458 | S | | 10/1986 | Pages |
| 4,834,237 | A | | 5/1989 | Henke et al. |
| 4,897,893 | A | | 2/1990 | Barker |
| 4,937,909 | A | | 7/1990 | Georgiou |
| 5,117,529 | A | | 6/1992 | Ohta |
| 5,139,139 | A | | 8/1992 | Goetz |
| 5,167,055 | A | | 12/1992 | Stoddart et al. |
| 5,178,274 | A | | 1/1993 | Long |
| 5,184,479 | A | | 2/1993 | Attenasio |
| 5,206,979 | A | | 5/1993 | Campbell |
| 5,283,928 | A | | 2/1994 | Linn et al. |
| 5,471,703 | A | | 12/1995 | Niven |
| 5,473,791 | A | | 12/1995 | Holcomb et al. |
| 5,571,562 | A | | 11/1996 | Wakat |
| 5,713,095 | A | | 2/1998 | Wakat |
| 5,735,399 | A | * | 4/1998 | Ste. Marie ..... 220/555 |

* cited by examiner

PAINTING APPARATUS

This is a continuation of application Ser. No. 09/551,702, filed on Apr. 18, 2000, now U.S. Pat. No. 6,279,194 entitled PAINTING APPARATUS, which was a continuation of Ser. No. 09/317,494 U.S. Pat. No. 6,145,158, filed on May 24, 1999 entitled PAINTING APPARATUS KIT, which was a division Ser. No. 08/838,860 of U.S. Pat. No. 5,956,802, filed on Apr. 11, 1997, entitled PAINTING APPARATUS AND ASSEMBLY.

FIELD OF THE INVENTION

The present invention relates generally to a painting apparatus. More particularly, it pertains to a multiple compartment painting tray for holding and metering paint for use with roller devices.

BACKGROUND OF THE INVENTION

Home decor often involves the tedious application of moldings, wallpaper, borders, and the like. Decorating a home with wall paper can become rather expensive since many rolls are required, and each roll of wall paper typically costs twenty to one hundred dollars. Furthermore, hanging the paper requires skill, patience, and time. Often, homeowners lack sufficient skill to properly hang wallpaper, or lack the time or patience to properly hang the wall paper. As a result, homeowners hire professionals to hang the wallpaper, increasing the cost to wallpaper a home. A further drawback of wall paper is that it is difficult to remove from wall surfaces when redecorating, particularly when the wallpaper is improperly hung. Yet another drawback of wall paper is that a homeowner must rely on the availability of patterns and colors, and hope that one is available which matches the style and color desired. Decorating with paint, therefore, has become an economical alternative to wall paper.

In part due to the reasons discussed above, painting a room has become a popular way to decorate a room. Some individuals previously considered painting as a boring option. However, now the increased availability of new colors in combination with many different methods of application can create a look quite similar to that of expensive wallpaper.

Paint is available in a wide variety of colors. Many stores also offer mixing services, where the store employee mixes a color based on a sample which you provide. Even with these variety of colors, a person applying the paint is limited to using only one color. Alternatively, a person may apply multiple layers, creating a look containing many colors. However, this is a very time consuming approach since typically the initial layer of paint must be dry before the next layer can be applied. Alternatively, the person applying paint can utilize several different paint pans. However, having multiple pans of paint out available for use creates other disadvantages. First, significant floor space is occupied by the multiple paint pans. The person may inadvertently step into the pan and spill excess paint on shoes, clothing, and even the floor. Second, the paint in a pan not used as frequently as the others may acquire a skin on the top surface due to a drying effect. This results in impurities which remain in the pan, and eventually contaminate the roller when the paint is applied to a wall.

One approach to providing multiple colors of paint is taught in "A Guide to Color & Decorating with Paint," published by Benjamin Moore & Co. of Toronto, Canada. A standard paint tray is provided, and a method for containing multiple colors is described. A piece of cardboard is inserted in the tray while the paint is being poured in, and the cardboard is then removed. However, this approach has several disadvantages. The paint colors may mix due to an uneven resting surface, or from agitation from the roller itself. The mixed colors create uneven results on the painted surface. Controlling the cardboard while simultaneously pouring paint is difficult. Further, the cardboard is full of paint when it is removed and is therefore an additional mess for a painter to deal with. Once the cardboard is removed, and the paint mixes due to an uneven resting surface or the pan is inadvertently kicked, the mistake of mixing the paint is irrevocable.

Accordingly, what is needed is a paint apparatus for accommodating a plurality of colors of paint. What is further needed is a way to ensure a paint application device is properly loaded.

SUMMARY OF THE INVENTION

A paint apparatus is provided for containing and dispensing paint. The paint apparatus is for use with a painting application device including rollers on which the paint is distributed. The paint apparatus has exterior walls which are defined in part by a lower surface, forming an open box. Two dividers are disposed within the box and extend from a first portion of the paint apparatus to a second portion. In another embodiment, the two dividers extend from opposing exterior walls and meet in a generally central portion of the paint apparatus. The dividers, in conjunction with the lower surface and the exterior walls, define a plurality of trays for paint. In one embodiment, three trays are provided. In another embodiment, four trays are provided.

The lower surface of the paint apparatus is disposed at an angle, such as 5 degrees. The lower surface is angled from the first portion and extends down toward a paint reservoir, located proximate to an exterior wall of the paint apparatus. The angle permits the excess paint to be directed toward the reservoir during use. One embodiment provides the first portion in generally a central location of the paint apparatus.

In one embodiment, the paint apparatus has a paint unloading section and a paint distribution section integrally formed with the lower surface. The paint unloading section includes a plurality of channels having a wave-like shape. The channels extend from the first portion of the paint apparatus, and permit excess paint to be disposed therein. The paint distribution section includes a series of projections, which are angled with respect to the dividers. The projections facilitate preparing the paint application device with an even distribution of paint.

Another embodiment of the invention includes a metering device. In one embodiment, the metering device includes two paint metering grids. The grids are disposed within the paint reservoir, and allow the paint to wick up the grids. The grids are provided with rectangularity or circularly shaped apertures for facilitating the wicking action. A painter fills the paint reservoir with paint to a position just below a top surface of the paint metering grids. Then, when the painter rolls a paint application device across the top surface, the device is appropriately loaded with paint. In another embodiment, the metering device comprises a metering mesh which is secured to a top surface of an exterior wall. The mesh flexes as a paint application device is rolled thereover. The excess paint is removed from the application device and drains back to the paint reservoir.

The paint apparatus as described above may be provided as part of a kit which would also include the paint metering grids. The kit also includes instructional materials, practice paper, a painting device, such as a roller with a variety of cover designs, for applying paint to a surface. The roller may include a printing roller, a shortened roller, or a bifurcated roller.

The paint apparatus provides a simple way to supply a plurality of paint colors, without risk of mixing the paint colors. The apparatus prevents waste of the paint used, and offers more flexibility to interior designers at low cost. Advantageously, the paint apparatus also prevents a painter from over or under loading the paint application device.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the spirit and scope of the present invention. Therefore, the following detailed description is not to be taken in a limiting sense, and the scope of the present invention is defined by the appended claims.

Figure 1:
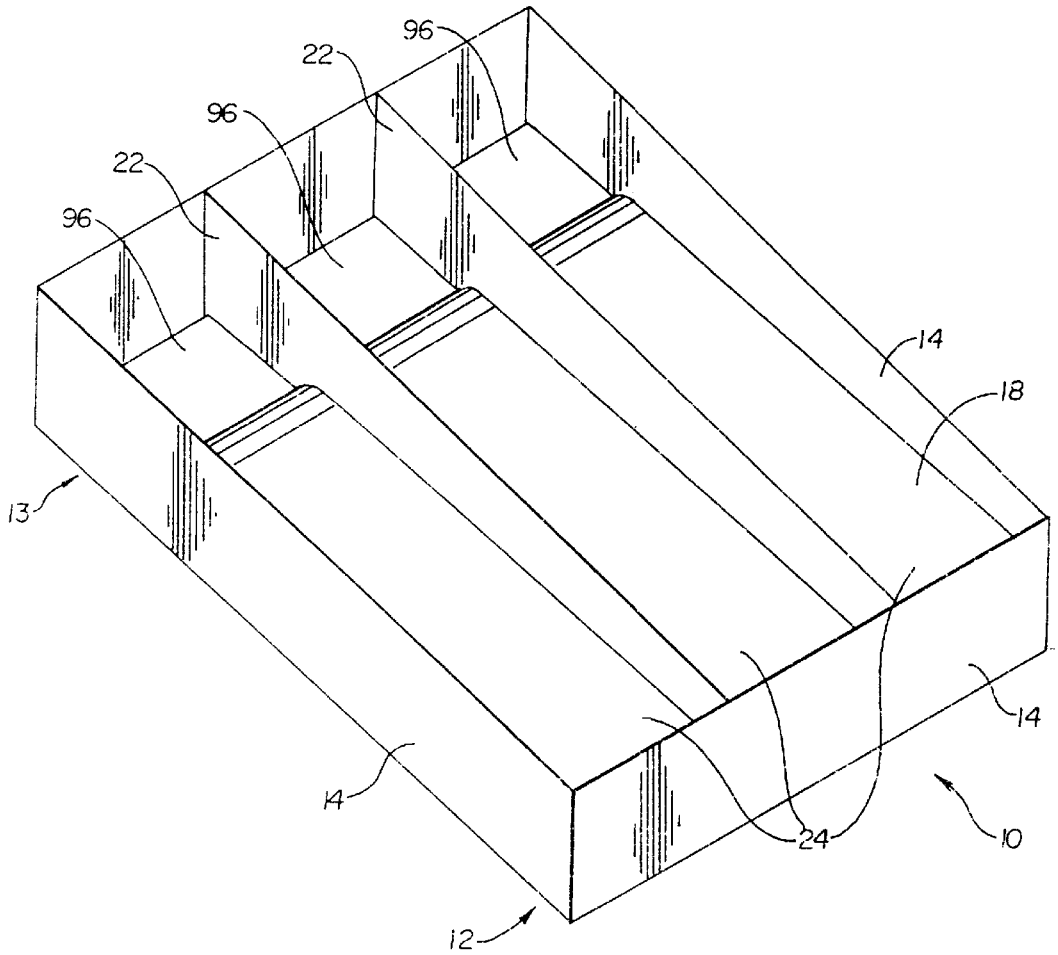
FIG. 1 is a perspective view illustrating a paint apparatus constructed in accordance with one embodiment of the present invention.

A paint apparatus 10 is shown in FIG. 1. The paint apparatus 10 is generally defined by exterior walls 14 and a lower surface 18 which form a frame for the apparatus 10, and create a box-like shape. Located within the apparatus 10 are a plurality of dividers 22, which form individual trays 24 within the paint apparatus 10. In one embodiment, there are two dividers 22. The exterior walls 14, in combination with the lower surface 18 and the dividers 22, form a paint reservoir 96 therein. The paint reservoir 96 holds paint for use with a paint application device (not shown).

The dividers 22, in one embodiment, extend from a first portion 12 of the paint apparatus 10 to a second portion 13 in a substantially parallel relationship. The dividers 22 are comprised of substantially flat walls which are connected with the lower surface 18 and extend upward to a point where a sufficient amount of paint can be retained by each individual tray 24 therein without disturbing the paint color in an adjacent tray. The height of the dividers 22 extends to substantially the same height as the exterior walls 14.

Figure 2:
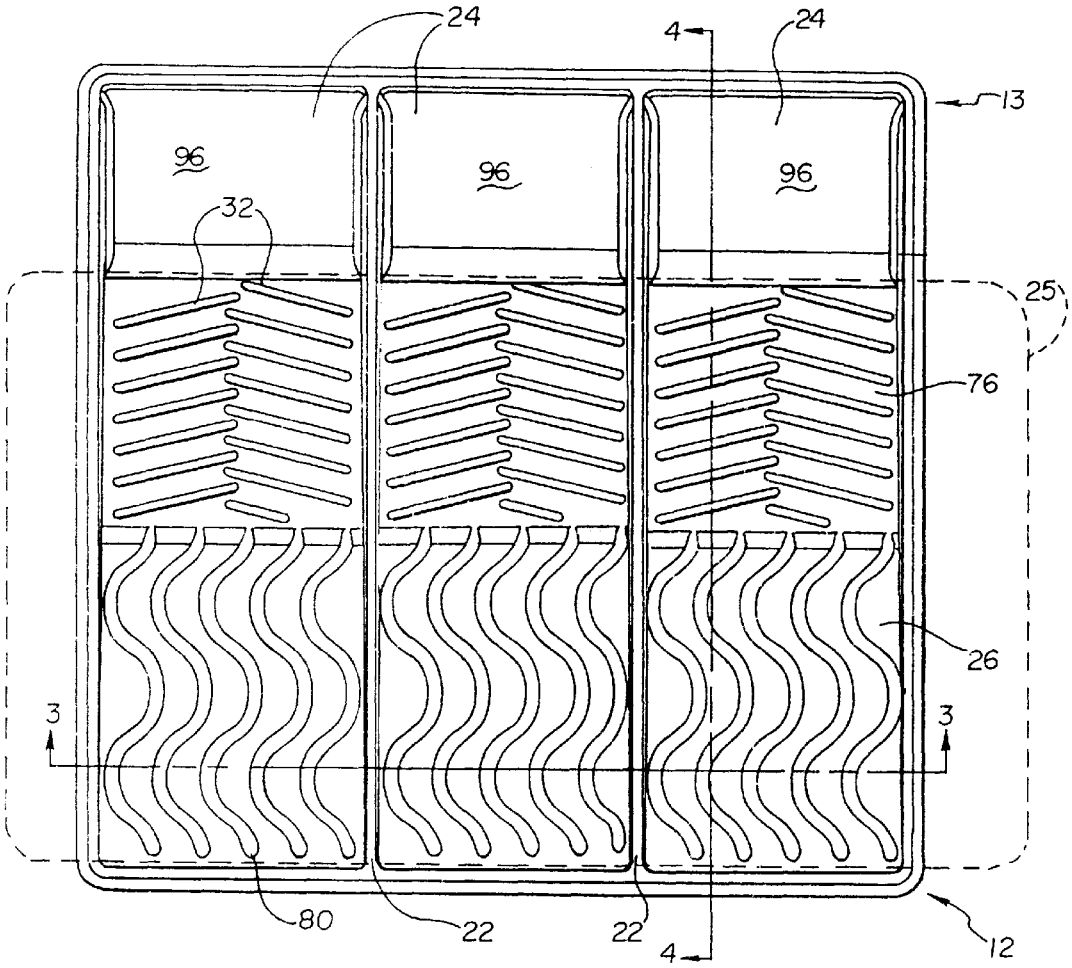
FIG. 2 is top plan view illustrating a paint apparatus constructed in accordance with one embodiment of the present invention.

A grid section 25 is proximately located to the first portion 12, as shown in FIG. 2. The grid section 25 is basically divided into a paint unloading section 26, and a paint distribution section 76, and is disposed in each of the individual trays 24. As will be obvious to those skilled in the art, the grid portions can either be fabricated integrally with the lower surface 18, or be fabricated in the form of an insert (not shown) to be used in conjunction with a paint pan.

Figure 3:
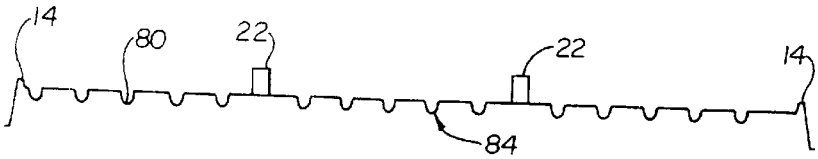
FIG. 3 is a side cut-away view taken along 3—3 of FIG. 2, illustrating a paint apparatus constructed in accordance with one embodiment of the present invention.

The paint unloading section 26 is illustrated in further detail in FIG. 3, which shows a cut-away view taken from FIG. 2. The paint unloading section 26 comprises a plurality of channels 80 disposed therein. In one embodiment, five channels are provided. The channels 80 begin proximate to the first portion 12 of the paint apparatus 10. The channels extend toward the paint reservoir 96, covering approximately half of the grid section 25. In another embodiment, the channels 80 form a wave-like shape, as shown in FIG. 2. The channels 80 are each bounded by two wave shaped parallel edge surfaces 82 (see FIG. 4) which direct excess paint from a paint application device into the channels 80. The channels 80 travel from side to side, such that paths formed by the wave shaped edge surfaces 82 of adjacent channels 80 overlap. The overlapping paths of the edge surfaces 82, in combination with the side-to-side travel of the channel, ensures that substantially the entire surface of the application device comes into contact with the edge surface 82 and relieves excess paint therefrom.

The channels 80 are sufficiently wide to permit the paint to be directed therein, and then freely flow toward the paint reservoir 96. As shown in FIG. 3, the channels 80 have a semicircular cross-section, although other cross-sections are contemplated within the scope of the invention. Channels 80 having insufficient width will not permit sufficient flow, and may result in paint drying within the channels. This is undesirable as the hardened paint becomes an impurity which potentially could be transferred to the painted surface by the paint application device. Furthermore, excess dried paint will act as a dam which inhibits the paint from freely flowing to the paint reservoir 96.

Figure 4:
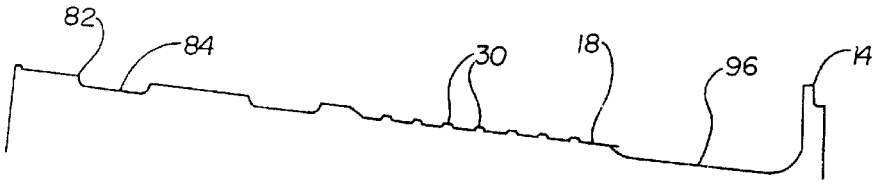
FIG. 4 is a side cut-away view taken along 4—4 of FIG. 2, illustrating a paint apparatus constructed in accordance with one embodiment of the present invention.

Referring to FIG. 4, the channels 80 extend down to a bottom channel surface 84. The bottom channel surface 84 is angled toward the paint reservoir 96, which facilitates the flow of excess paint toward the paint reservoir 96. The channels provide a convenient and effective way to unload excessive paint from a paint application device.

The paint distribution section 76 is illustrated in further detail in FIG. 4, which shows a cut-away view taken from FIG. 2. The paint distribution section 76 comprises a plurality of projections 30, which extend up from the lower surface 18 of the paint apparatus 10. The projections 30 are each generally straight lines, which are generally disposed in two columns 32 (see FIG. 2). The two columns 32 are generally parallel with the dividers 22, and the projections 30 of each column 32 overlap each other in a central portion. As shown in FIG. 2, the projections are angled with respect to the dividers. However, other configurations of the projections could be used, and are considered within the scope of the invention. The angle of the projections 30 facilitates rolling of the paint application device, and spreading of the paint on the paint application device.

Each projection 30 has substantially a semicircular cross-section, although other cross-sections are contemplated within the scope of the invention. The profile of the each projection 30 is smaller than the profile of each channel 80. The height and width of each projection 30, in conjunction with the angled disposition of the projections 30, are sufficient to initiate the rolling process of the paint application device within the paint apparatus 10.

The bottom channel surface 84 is proximate to the lower surface 18 from which the projections 30 extend. Excess paint is directed to the lower surface 18 proximate to the projections 30. The projections 30 further facilitate an even distribution of paint over the surface of the paint application device. Paint which is not loaded on to the paint application device drains down the paint unloading section 26 toward the paint reservoir 96 for later use.

Figure 5:
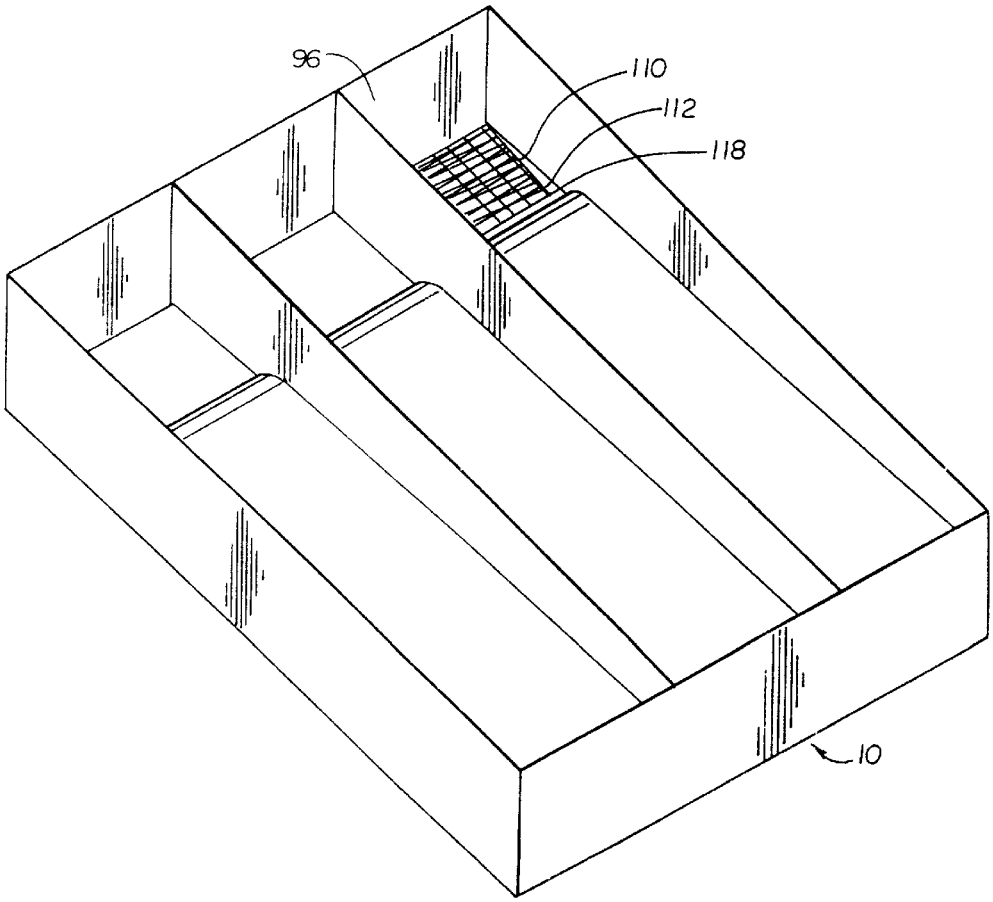
FIG. 5 is a perspective view illustrating a paint apparatus having the first and second grids assembled therein.
Figure 6:
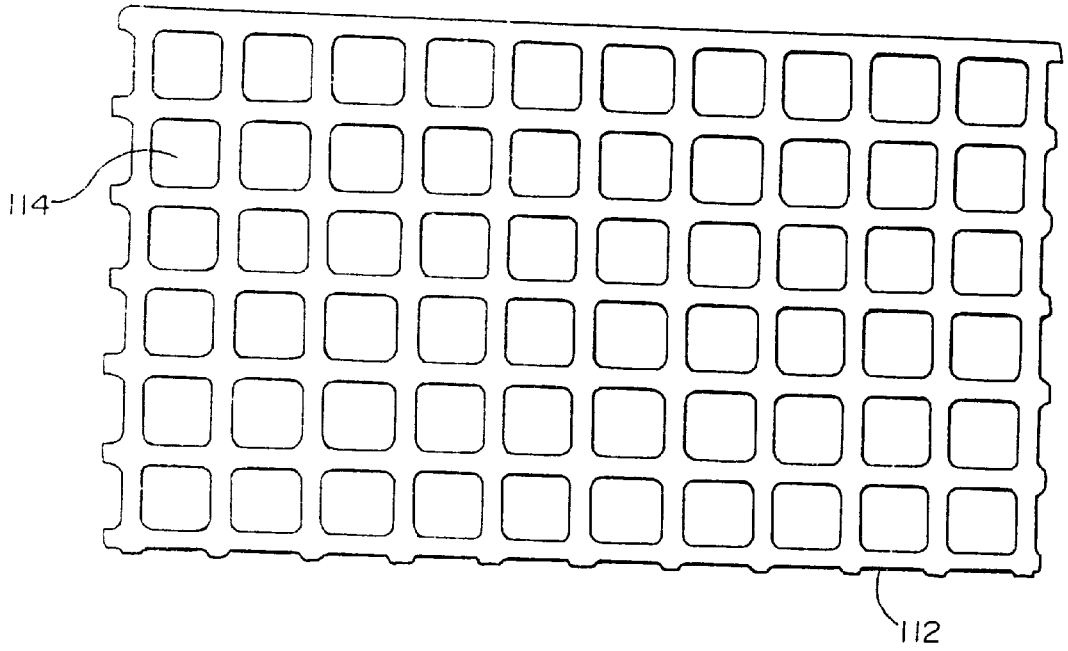
FIG. 6 is top plan view illustrating a second grid constructed in accordance with one embodiment of the present invention.
Figure 7:
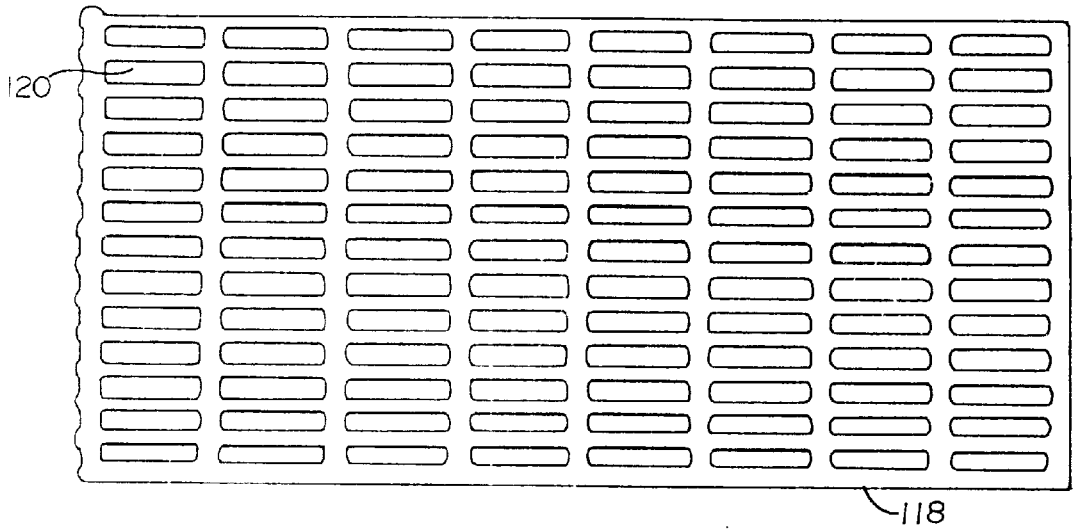
FIG. 7 is top plan view illustrating a first grid constructed in accordance with one embodiment of the present invention.

As illustrated in FIG. 5, the paint apparatus 10 is provided with a metering device 110 therein. The metering device 110 is disposed in the paint reservoir 96, and apportions the amount of paint dispensed therefrom. In one embodiment, the metering device 110 comprises first and second metering grids 112, 118. The first metering grid 112, as shown in FIG. 6, is generally rectangular in shape. The first metering grid 112 is provided with a plurality of apertures 114. The apertures 114 are substantially square in shape, although other shapes are contemplated. The apertures 114 are disposed through the grid, thereby permitting paint to flow therethrough. As shown in FIG. 7, the second metering grid 118 is also provided with a plurality of apertures 120. The apertures 120 are generally rectangular in shape, and extend through the grid 118 such that paint can flow through. The first and second metering grids 112, 118 are each fabricated from plastic material and are each approximately 0.125 inches thick. However, other thicknesses and materials are suitable for use within the invention.

The metering grids 112, 118 are both disposed within the paint reservoir 96. The first metering grid 112 is placed on the lower surface 18 of the paint reservoir 96, and the second metering grid 118 is placed on the first metering grid 112. The first and second metering grids 112, 118 are situated loosely within the paint reservoir 96, and are generally not secured to the paint apparatus 10. Alternatively, the second metering grid 118 could be placed on the lower surface 18, and the first metering grid 112 then is placed on the second metering grid 118. The paint is then poured over the grids 112, 118 until it reaches a top surface of the grids. Paint is metered out when a paint application device (not shown) is rolled over the metering grids 112, 118 and paint is agitated to a top surface of the grids 112, 118. The grids 112, 118 prevent the paint application device from being dipped too far into the paint in the paint reservoir 96. The grids appropriately load the paint application device without the risk of overloading the application device. Advantageously, the grids are removable, which facilitates cleaning the metering grids after a painting session.

The paint apparatus 10 is formed by thermoforming an approximately 0.060 inch thick sheet of styrene. The styrene is heated to soften the material, and then placed over a mold. The sheet can be either pulled by vacuum against the mold, or forced using the mold itself. Although thermoforming the paint apparatus 10 is practical and economical way to produce the apparatus, other methods of manufacture could also be used.

Figure 8:
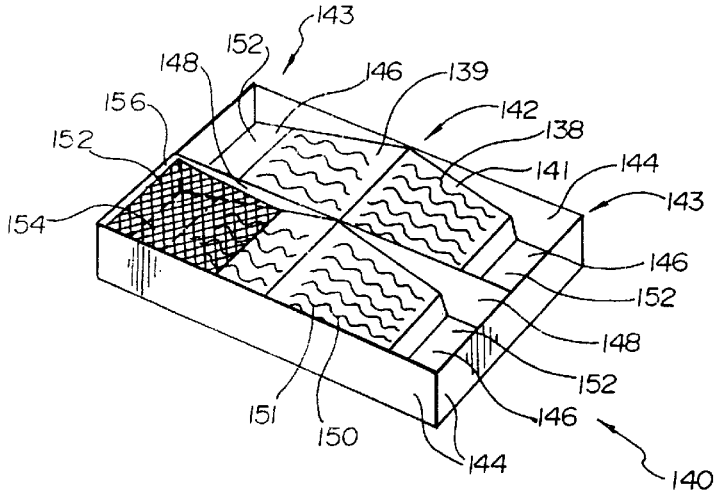
FIG. 8 is a perspective view illustrating a second paint apparatus constructed in accordance with one embodiment of the present invention.

A second paint apparatus 140 is illustrated in FIG. 8. The second paint apparatus 140 is generally defined by exterior walls 144 and a lower surface 141 which form a frame for the apparatus 140, and create a box-like shape. Located within the apparatus 140 are a plurality of dividers 148, which form individual trays 152 within the second paint apparatus 140. In one embodiment, there are two dividers 148, however one single divider could also be used. The exterior walls 144, in combination with the lower surface 141 and the dividers 148 form a paint reservoir 146 therein. The paint reservoir 146 holds paint for use with a paint application device (not shown). In one embodiment, the paint reservoir 146 is sized to hold approximately 130 cubic inches of paint therein.

The dividers 148, in one embodiment, extend from a first central portion 142 of the second paint apparatus 140 to a second portions 143. The dividers 148 each start from the central portion 142 and extend outward in opposite directions, such that four individual trays 152 are formed thereby. The dividers 148 are comprised of substantially flat walls which are connected with the lower surface 141 and extend upward to a point where a sufficient amount of paint can be retained by each individual tray 152 therein without disturbing the paint color in an adjacent tray. The height 142 to the paint reservoir for facilitating the flow of paint thereto. The lower surface 141 of the second paint apparatus 140 also has a plurality of channels 150 disposed therein. The channels 150 begin proximate to the first central portion 142 of the second paint apparatus 140 and extend toward the paint reservoir 146. In one embodiment, the channels 150 form a wave-like shape. The wave shape of the channels 150 provides an edge surface 151 which directs excess paint from a paint application device into the channels 150. The wave shape travels from side to side, and the path of the edge surface for the individual channels 150 overlap. The overlapping paths of the edge surfaces 151, in combination with the side-to-side travel of the channels 150 ensures that substantially the entire surface of the application device comes into contact with the edge surface 151 and relieves excess paint therefrom.

The channels 150 are sufficiently wide to permit the paint to be directed therein, and then freely flow toward the paint reservoir 146. The channels 150 have a semicircular cross-section, although other cross-sections are contemplated within the scope of the invention. Channels 150 having insufficient width will not permit sufficient flow, and may result in paint drying within the channels. The dry paint could interfere with the final appearance of the surface to be painted.

Moreover, channels 150 of insufficient width could permit hardened paint to create a dam which obstructs the flow of paint to the paint reservoir 146. The channels 150 provide a convenient and effective way to unload excessive paint from a paint application device.

The second paint apparatus 140 is provided with a metering mesh 154. The metering mesh 154 is removably secured to a top surface 156 on one of the exterior walls 144. Alternatively, the metering mesh 154 is secured to a side surface of one or more of the exterior walls. In one embodiment, the metering mesh 154 is secured using plastic push pins. The metering mesh 154 extends to a point where it rests on the lower surface 141. The mesh 154 is fabricated from a plastic mesh material which allows paint to flow therethrough. The mesh 154 flexes down as a paint application device (not shown) is rolled over the mesh 154. The device becomes loaded with paint, and further rolling on the mesh 154 unloads surplus paint from the application device. The application device is further unloaded with paint as the device is rolled over the channels 150. Although only one metering mesh is shown in FIG. 8, a metering mesh could be provided for each individual tray 152.

The second paint apparatus 140 advantageously and conveniently provides four individual trays in a single device, although other configurations would permit different number of trays. The trays could be used to provide multiple, different colors of paints, or other varieties of materials. The apparatus 140 also provides a convenient way to unload excess paint from a paint application device, and prevent the device from being overloaded.

The second paint apparatus 140 is formed by thermoforming an approximately 0.125 inch thick sheet of HDPE. The thermoplastic is heated to soften the material, and then placed over a mold. The sheet can be either pulled by vacuum against the mold, or forced using the mold itself. Although thermoforming the paint apparatus 140 is practical and economical way to produce the apparatus, other methods of manufacture could also be used.

Figure 9:
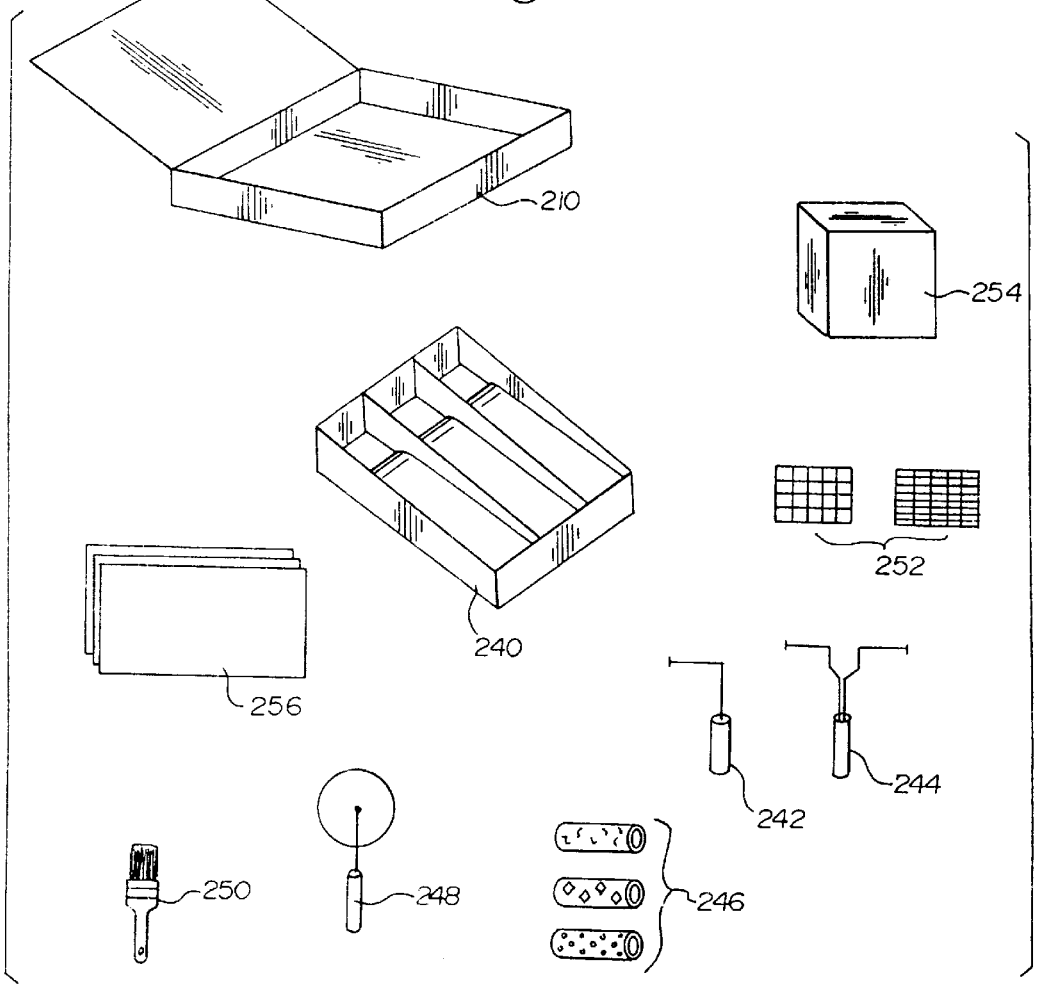
FIG. 9 is an exploded view illustrating a paint apparatus assembly constructed in accordance with one embodiment of the present invention.

A paint holding and dispensing assembly 200, as illustrated in FIG. 9, is provided containing the following main items: a paint apparatus 240, a paint application device having a single roller 242, a bifurcated roller device 244 having two rollers, design covers 246, an edge foam roller 248, a paint brush 250, metering grids 252, and practice paper 256.

The assembly 200 also includes a storage container 210. The storage container 210 provides a convenient place to store all of the accessories to the assembly 200 therein. Furthermore, the storage container 210 is sturdy, yet light enough to ship the contents of the assembly 200 in the storage container 210. For instance, the storage container 210 could be made from corrugated cardboard.

The paint apparatus 240 provided within the assembly can include the paint apparatus 10, as described above. Alternatively, the second paint apparatus 140 could be provided within the assembly 200. Further provided with the assembly 200 are the metering grids 252 for use with the paint apparatus 10, which operate as explained earlier.

Various paint application devices are provided with the assembly 200, including an edge foam roller 248 and a paint brush 250. Another paint application device provided is one having a single roller 242 permits a single cover to be mounted thereon. The design covers 246 can be mounted on either the single roller 242 or the bifurcated roller 244. The design covers 246 are provided with a variety of designs such as teddy bears, diamonds, or triangles. Alternatively, some of the design covers 246 may have a smooth surface.

The bifurcated roller device 244 includes a frame arrangement having a primal end portion having a handle or grip affixed thereto and a distal end portion having rotatably mounted hereto a pair of roller portions. The distal end portion is bifurcated and includes an open-ended slot. The distal end portion includes a pair of generally L-shaped metal rods welded at a junction and having an integral end on which one roller portion is mounted. If desired, each of the rods may have one or more bends therein between the handle and the roller portions.

Four bars for further mounting one of the roller portions are fixed in and extend between a proximal disk-like roller mount and a respective distal plastic roller mount. The roller portion includes a nap affixed to a cylindrical base. The bars frictionally engage the base, thereby permitting proximal end portions of the roller portions to be adjusted to and away from each other, and to stay fixed at the adjusted position for painting. A preferred spread between the proximal end portions falls in the range of between about two inches and about five inches. The nap may be fleece or mohair, although other types of nap may prove suitable for use with the present invention. The radial length of the nap may fall in a range of between about ⅛ inches and 1½ inches.

The assembly 200 includes instructional materials 254 for explaining how to effectively use the assembly 200. The instructional materials 254 may come in a variety of formats, including, but not limited to, audio tapes, video tapes, paper brochures, books, and pictures. Alternatively, the instructions 254 could be printed directly on the storage container 210. For uneasy painters, several sheets of practice paper 256 are further included with the assembly. Advantageously, the practice sheets allow the painter to develop design ideas before committing them to a larger surface area.

During use of the paint apparatus 10, a bifurcated roller (see FIG. 9) is rolled on to the paint apparatus 10 such that each of the roller portions picks up paint from a different receptacle portion. The roller portions are rolled over the projections for distributing the paint on the roller, and paint is re-distributed over the roller. The roller portions are also rolled over the channel portions which remove excess paint. As the roller portion contacts the edge surfaces of the channels, paint drops into the channels. The channels direct the paint toward the grid portion containing the projections, and the paint drains further into the paint reservoir. Then, the bifurcated roller is rolled on a surface to be painted.

A single roller is used in conjunction with the remaining tray. Typically, an embossed roller having special designs works well. The metering grids are first placed within the paint reservoir. Then, paint is poured into the paint reservoir up to the top surface of the metering grids. The embossed design roller is rolled over the metering grids, which agitates the paint up the surfaces of the metering grids. The design roller is appropriately loaded with paint since the painter is prevented from dipping the entire roller into the paint reservoir.

The second paint apparatus is used in a similar manner. Paint is poured into the multiple paint reservoirs to each tray. The metering mesh is secured to the top surface of the exterior wall. Either using a bifurcated roller or a single roller, the painter rolls the roller device over the metering mesh. The mesh flexes, allowing the roller device to come in contact with the paint. When the roller device is rolled back, the mesh aids in removing excess paint from the roller. The roller is rolled over the channels. The edge surfaces of the channels direct the remaining excess paint on the roller into the channels and back to the paint reservoir. The channels help remove excess paint on the roller device, and also further re-distribute the paint.

The paint apparatus and its various embodiments advantageously provide a convenient way to offer multiple colors to painters in a single device. The apparatus distributes the paint and drains excess paint from the paint application device such that paint can be evenly distributed on to a surface. The dividers within the apparatus prevent the various colors from mixing, while the channels prevent the application device from being overloaded. Furthermore, the metering device further provides a way to ensure that the roller application device is not overloaded with paint.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A paint apparatus for containing paint and usable with a painting application device that includes a paint roller for receiving the paint, the paint apparatus comprising:

a plurality of walls;

a lower surface contiguous with the walls, the lower surface and plurality of walls forming an open box;

at least one divider disposed within the walls forming a plurality of individual trays, the at least one divider connected with the lower surface and extending from one of the plurality of walls toward an opposite one of the plurality of walls;

a paint unloading section integrally formed with the lower surface, the paint unloading section including at least one channel for returning excess paint in the direction of gravity; and a paint distribution section integrally formed with the lower surface, the paint distribution section separate from the paint unloading section and including a plurality of projections extending from the lower surface for distributing paint on the painting application device.

2. The paint apparatus of claim 1, wherein one of the plurality of walls comprises an end wall and at least two of the plurality of wails comprise side walls disposed substantially parallel to one another, the side walls connected to the end wall.

3. The paint apparatus of claim 2, wherein at least a portion of the lower surface slopes downward toward the end wall providing each individual tray of the paint apparatus with a variable depth.

4. The paint apparatus of claim 2, wherein the at least one divider is disposed substantially parallel to the side walls.

5. The paint apparatus of claim 2, wherein the paint unloading section comprises a plurality of channels.

6. The paint apparatus of claim 5, wherein the plurality of channels extend in a generally parallel direction relative to the side walls of the paint apparatus.

7. The paint apparatus of claim 2, wherein each individual tray comprises at least one channel.

8. The paint apparatus of claim 7, wherein each at least one channel is disposed in a generally parallel direction relative to the side walls of the paint apparatus.

9. The paint apparatus of claim 1, wherein the at least one divider has a height that generally keeps the paint contained in one individual tray from mixing with the paint contained in an adjacent individual tray.

10. The paint apparatus of claim 1, wherein the paint distribution section is substantially adjacent to the paint unloading section.

11. The paint apparatus of claim 1, wherein the plurality of walls, the lower surface and the at least one divider are comprised of plastic material.

12. A paint apparatus for containing paint and usable with a painting application device that includes a paint roller for receiving the paint, the paint apparatus comprising:

a plurality of walls;

a lower surface contiguous with the walls to form an open box, the lower surface having a paint unloading section including at least one channel for returning excess paint in the direction of gravity, and a paint distribution section separate from the paint unloading section and including a plurality of projections extending from the lower surface for distributing paint on the painting application device; and a divider connected with the lower surface and extending from one of the plurality of walls toward an opposite one of the plurality of walls to form a plurality of individual trays in the paint apparatus.

13. The paint apparatus of claim 12, wherein the paint unloading section is integrally formed with the lower surface.

14. The paint apparatus of claim 12, wherein the paint distribution section is integrally formed with the lower surface.

15. The paint apparatus of claim 12, wherein the paint distribution section is substantially adjacent to the paint unloading section.

16. The paint apparatus of claim 12, wherein the paint distribution section is in fluidic connection with the paint unloading section.

17. The paint apparatus of claim 12, wherein the one of the plurality of walls from which the divider extends comprises an end wall.

18. The paint apparatus of claim 17, wherein at least a portion of the lower surface slopes toward the end wall providing each individual tray of the paint apparatus with a variable depth.

* * * * *